US006676498B1

(12) United States Patent
Smith

(10) Patent No.: US 6,676,498 B1
(45) Date of Patent: Jan. 13, 2004

(54) BI-DIRECTIONAL GRINDER

(76) Inventor: Ronald Smith, 3749 Eagle Rd., Slatington, PA (US) 18080

( * ) Notice: Subject to any disclaimer, the term of this patent is extended or adjusted under 35 U.S.C. 154(b) by 6 days.

(21) Appl. No.: 10/081,795

(22) Filed: Feb. 22, 2002

(51) Int. Cl.[7] ..... B24B 23/00

(52) U.S. Cl. ..... 451/344; 451/358; 451/363; 451/457; 451/479; 451/342; 30/263

(58) Field of Search ..... 451/358, 363, 451/344, 342, 457, 508, 479; 279/131, 2.1; 125/15, 13.01; 83/489, 490, 491; 30/263–264, 388–391, 276

(56) References Cited

U.S. PATENT DOCUMENTS 4,306,383 A * 12/1981 Gress ..... 451/342
4,467,896 A * 8/1984 Sauerwein et al. ..... 188/69
4,690,252 A * 9/1987 Kottke et al. ..... 188/69
5,163,252 A * 11/1992 Garner et al. ..... 451/451
5,406,752 A * 4/1995 Neff ..... 451/344
6,093,090 A * 7/2000 Tosto et al. ..... 451/342

* cited by examiner

*Primary Examiner*—George Nguyen
(74) *Attorney, Agent, or Firm*—Goldstein Law Offices, P.C.

(57) ABSTRACT

A bi-directional grinder for allowing an operator to change the direction of rotation of the wheel, having a housing, a motor capable of bi-directional rotation, and a shaft. The grinding wheel is mounted on the shaft within a shroud and attached to the shaft with a locking mechanism. The shaft has a left threaded bottom portion and a right threaded bore therein. Once the grinding wheel is positioned on the shaft, a nut is tightened onto the threaded bottom portion of the shaft to tighten the wheel against the shoulder. A bolt with a broad head is inserted into the shaft bore so that the broad head is tightened against the nut. A spring loaded pin extends through the housing and is mateable with an off center transverse hole in the circular gear. When aligned, the pin may be inserted into the gear hole to cause the gear and shaft to cease rotation.

10 Claims, 3 Drawing Sheets

BI-DIRECTIONAL GRINDER

BACKGROUND OF THE INVENTION

The invention relates to a bi-directional grinder. In particular, the invention is a grinder that is capable of rotating its grinding wheel in a clockwise or counterclockwise direction for the purpose of guarding the operator and those in the area from injury.

Ordinary grinding wheels are designed to rotate in one direction. This practice often results in many injuries to the operator, as well as those in the near vicinity to the wheel, from hot metal sparks flying from the wheel. Even wearing proper safety equipment cannot completely safeguard those working with the grinding wheel from burns caused by contact with the sparks.

Thus, there exists a need for a bi-directional grinder with a safety mechanism incorporated therein for protecting the operator from injury. Such a grinder would have a switch to reverse the direction of the wheel, thereby diverting the direction of the metal sparks spit from the wheel away from any persons in the area of the wheel, and the wheel would have to be mounted so that it remains securely attached to the grinder regardless of its direction of rotation.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved bi-directional grinder. As such, the general purpose of the present invention, which will be described subsequently in greater detail, is to provide a new and improved bi-directional grinder which has all the advantages of the prior art and none of the disadvantages.

To attain this, the present invention essentially comprises a bi-directional grinder for allowing an operator to change the direction of rotation of the wheel to avoid damage or injury, having a housing, a motor capable of bi-directional rotation, and a shaft. A gear is attached on the shaft and is in communication with the motor. The grinding wheel is mounted on the shaft within a shroud that extends outward from the housing. The wheel is attached to the shaft with a locking mechanism that ensures immobility of the wheel when the wheel is being changed. The shaft has a shoulder, a left threaded bottom portion and a right threaded bore therein. Once the grinding wheel is positioned on the shaft, a nut is tightened on the bottom portion of the shaft onto the threaded bottom portion of the shaft to tighten the wheel against the shoulder. A bolt with a broad head is inserted into the shaft bore so that the broad head is tightened against the nut. A spring loaded pin extends through the housing and is mateable with the circular gear, the gear having an off center traverse hole. When the pin and the gear hole are aligned, the pin may be inserted therein to cause the gear and shaft to cease rotation, to allow the grinding wheel to be easily replaced.

It is an object of the invention to produce a bi-directional grinder wherein the direction of the spinning wheel may be changed in order to divert hot metal sparks from coming into contact with the operator. Accordingly, the wheel has a switch incorporated therein to allow the operator to change the direction of the motor and thus the grinding wheel, thereby changing the direction of the sparks.

It is a further object of the invention to produce a bi-directional grinder having a grinding wheel that would not loosen or come apart when operated in the reverse direction. Accordingly, a locking system is incorporated into the grinding wheel to prevent the bolt from unscrewing from the housing during rotation.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
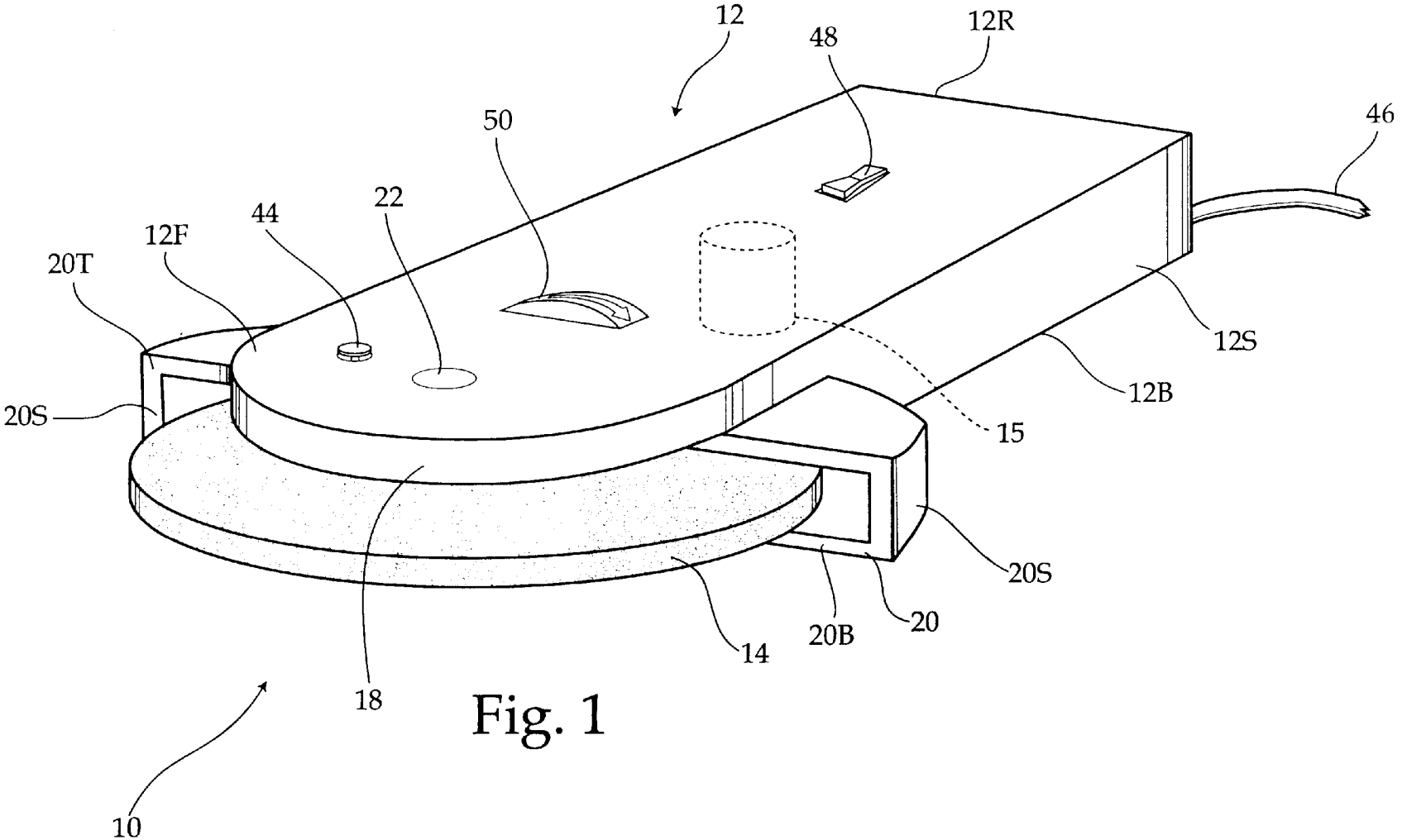
FIG. 1 is a perspective view of a bi-directional grinder.
Figure 2:
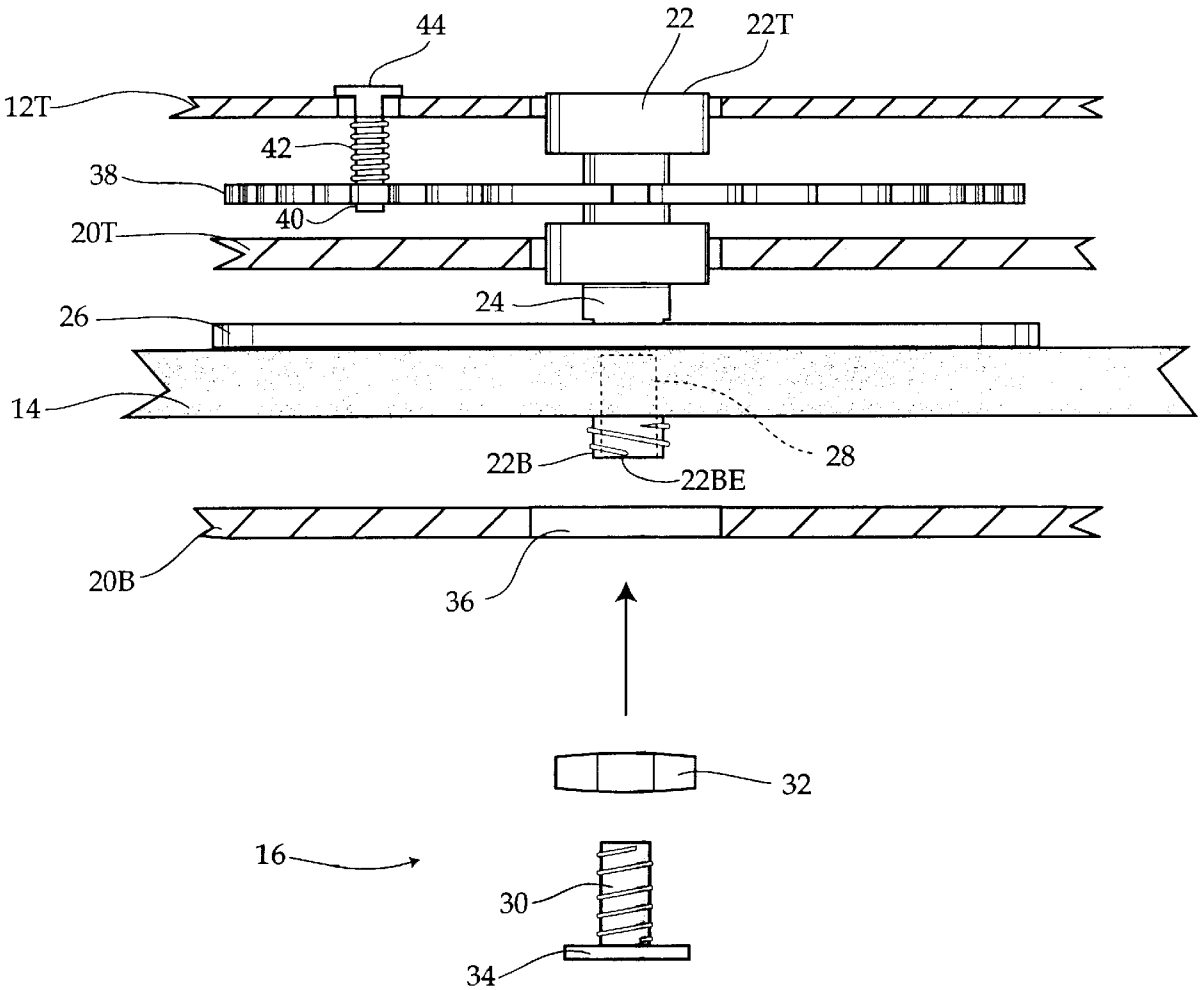
FIG. 2 is a cross-sectional exploded view thereof.
Figure 3:
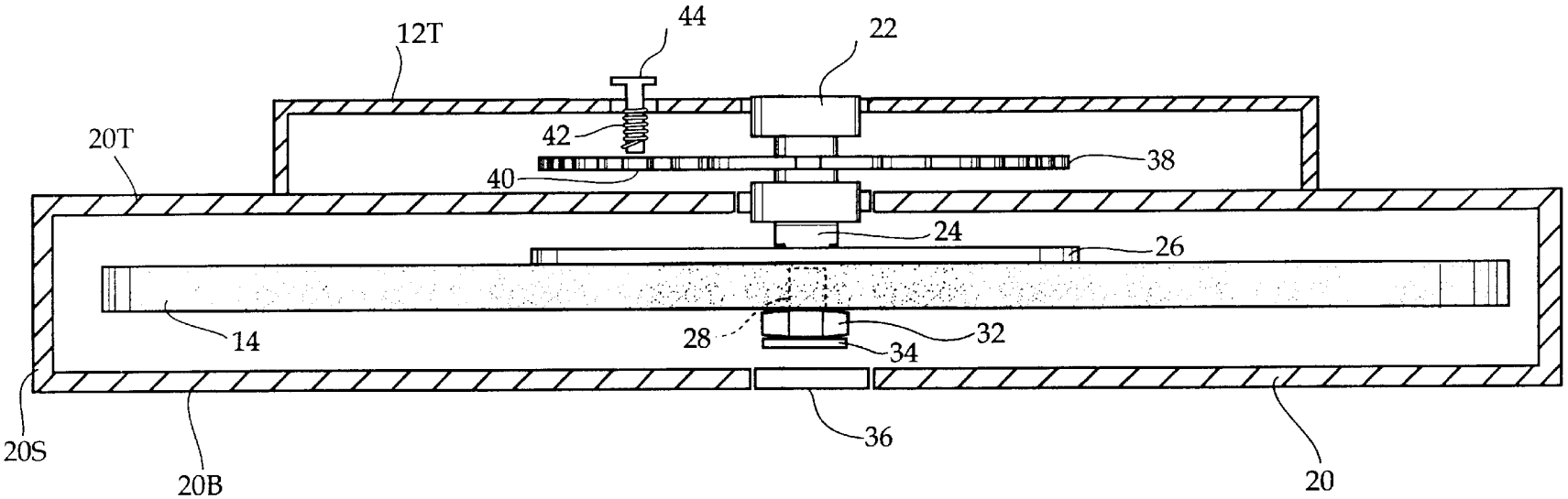
FIG. 3 is a cross-sectional view of the bi-directional grinder.

10 bi-directional grinding wheel
12 housing
12F front end of housing
12R rear end of housing
12S sides of housing
12T top surface of housing
14 grinding wheel
15 motor
16 locking mechanism
18 mouth portion
20 shroud
20T top wall of sleeve
20B bottom wall of sleeve
22 shaft
22T top portion of shaft
22B threaded bottom portion of shaft
22BE bottom end of shaft
24 shoulder of shaft
26 back plate
28 shaft bore
30 bolt
32 nut
34 broad head of bolt
36 opening in bottom wall of shroud
38 gear
40 hole in gear
42 spring loaded pin
44 button head of spring loaded pin
46 electrical cord
48 power switch
50 directional switch

DETAILED DESCRIPTION OF THE PREFERRED EMBODIMENTS

FIG. 1 illustrates a bi-directional grinder 10 essentially comprising a housing 12, a grinding wheel 14 positioned within the housing 12, a motor 15, a shaft 22 driven by the motor 15, and a locking mechanism 16 that holds the wheel 14 securely on the shaft 22.

The housing 12 has a front end 12F, a rear end 12R, two sides 12S, and a top surface 12T. The front end 12F has a shroud 20 that is rounded with an open mouth portion 18, said mouth 18 incorporating the grinding wheel 14, such that the grinding wheel 14 extends partially outward from the mouth portion 18 of the shroud 20. The shroud 20 has a pair of side walls 20S, a top wall 20T and a bottom wall 20B, wherein the grinding wheel 14 extends spaced therebetween. The bottom wall 20B of the shroud 20 has an opening 36 through which it may accommodate the locking mechanism 16, which will be described in more detail hereinafter.

A directional switch 50 is positioned on the housing 12, preferably on the top surface 12T for easy access by the operator. The directional switch 50 is in communication with the motor 15, to reverse rotational direction of the motor 15, the shaft 22, and thus the grinding wheel 14, thereby allowing the operator to change the direction of the wheel 14 as desired and necessary.

The shaft 22 extends vertically within the housing 12 and runs through the grinding wheel 14, wherein said grinding wheel 14 is fastened to the locking mechanism 16. In particular, the shaft 22 has a top portion 22T and a bottom portion 22B, the bottom portion 22B extending below the grinding wheel 14. The shaft 22 also has a bottom end 22BE extending transversely fully opposite from the top portion 22T. The shaft 22 has a shoulder 24 between the top portion 22T and bottom portion 22B on which a back plate 26 is positionable. The back plate 26 also rests on top of the grinding wheel 14. The bottom portion 22B of the shaft 22 is threaded in a first direction and has a bore 28 extending upward into the grinding wheel 14, said bore 28 having threading in a second, opposite direction compared to the shaft bottom portion 22B. By way of example, the shaft bottom portion 22B is "left" threaded and the bore has "right" threading. The locking mechanism 16 essentially comprises a nut 32 which engages the shaft bottom portion 22B to tighten against the grinding wheel 14. A bolt 30 is provided which has a broad head 34 larger than the nut 32. This configuration allows the bolt 30 to be inserted into the bore 28 such that the broad head 34 is tightened against the nut 32. The bolt 30 has threading in the same direction as the bore 28 and therefore is mateable with the shaft bore 28 and the nut 32 has threading in the same direction as the threaded bottom portion 22B and therefore is mateable with the bottom portion 22B of the shaft 22. However, this configuration allows the nut 32 to remain fixed tightly against the grinding wheel 14, despite the direction it rotates.

A circular gear 38 is fixedly mounted to the shaft 22 positioned between the top platform 20T of the sleeve 20 and the top surface 12T of the housing 12. The circular gear 38 may be configured to transmit power from the motor 15 to the shaft 22. A spring loaded pin 42 extends through the housing top surface 12T and is selectively mateable with a hole 40 located off center on the gear 38 and extends transversely the width of the gear 38. The pin 42 has a button head 44 that rests above the top surface 12T of the housing 12.

In use, the direction in which the grinding wheel 14 turns may be altered by simply operating the directional switch 50 to reverse the rotational direction of the motor 15. In order to remove the wheel 14 or change its direction, the spring loaded pin 42 is depressed by applying pressure to the button head 44 of said pin 42. Pressing the button head 44 downward onto the top surface 12T of the housing 12 forces the pin 42 to come into contact with the gear 38. The gear 38 is rotated by hand until the pin 42 is aligned with the hole 40. Once aligned, the pin 42 is pushed further downward until it is inserted therein and causes the gear 38, and this the shaft 22, to cease rotation. The grinding wheel 14 may then be removed or replaced. Once the wheel 14 is in place on the shaft 22 against the back plate 26, the nut 32 is tightened onto the threaded bottom portion 22B of the shaft 22 and against the grinding wheel 14. The bolt 30 is threaded into the shaft bore 28 and tightened so that the broad head 34 of the bolt 30 effectively prevents the nut 32 from loosening. Once securely in place, the pin 42 may be released, thereby allowing the gear 38 to rotate. The interaction between the bolt 30 and nut 32, and the opposed threading thereof effectively allow the wheel 14 to rotate in both directions while remaining securely attached to the shaft 22.

The bi-directional grinding wheel 10 is operated by electrical power, and may be plugged into a wall socket to receive power. An electrical cord 46 is positioned at the rear end 12R of the housing 12 so as not to interference with the operation of the grinding wheel 10. A power switch 48 is located on the housing 12, preferably on the top surface 12T for convenient access by the operator.

In conclusion, herein is presented a bi-directional grinder. The invention is illustrated by example in the drawing figures, and throughout the written description. It should be understood that numerous variations are possible, while adhering to the inventive concept. Such variations are contemplated as being a part of the present invention.

What is claimed is:

1. A bi-directional grinder comprising:

a grinding wheel;

a housing having a front end, a rear end and a top surface;

a shroud having a top wall, a bottom wall, and a pair of side walls that extend from the housing, the shroud also having an open mouth portion, wherein the grinding wheel is mounted within, and partially enclosed by, the shroud such that a portion of the grinding wheel extends from the open mouth;

a shaft, having a top portion and a bottom portion which is threaded in a first direction, the shaft extending vertically within the shroud for mounting the grinding wheel, wherein the bottom portion has a bottom end with a bore that extends upwardly therefrom and is threaded in a second direction which is opposite from the first direction;

a locking mechanism being in communication with the bottom portion of the shaft, the locking mechanism comprising a nut and a bolt with a broad head, wherein the nut mates with the bottom portion of the shaft to tighten the grinding wheel thereon and the bolt mates with the bore at the bottom portion of the shaft so that the bolt tightens against the nut and the broad head prevents the nut from loosening;

a drive motor for rotating the shaft and the grinding wheel mounted thereon, the drive motor being capable of bi-directional rotation; and a circular gear mounted coaxially on the shaft, the circular gear being in communication with the drive motor and allowing the grinding wheel to rotate, wherein the circular gear has an off-center hole extending transversely through its width.

2. The bi-directional grinder as recited in claim 1, further comprising a spring-loaded pin that selectively extends downward from the top surface of the housing and, inserts into the off-center hole so as to prevent movement of the circular gear and seizure of the shaft while a user removes or replaces the grinding wheel.

3. The bi-directional grinder as recited in claim 2, wherein a button head rests on the top surface of the housing and, when depressed by the user, causes the spring-loaded pin to engage the circular gear.

4. The bi-directional grinder as recited in claim 3, wherein the broad head has a diameter that is larger than that of the nut.

5. The bi-directional grinder as recited in claim 4, wherein the shaft has a shoulder onto which a back plate and grinding wheel are mounted before the nut is tightened thereagainst.

6. The bi-directional grinder as recited in claim 5, wherein the bi-directional grinder is operated by electrical power and a power cord extends from the rear end of the housing.

7. The bi-directional grinder as recited in claim 6, further comprising a directional switch in communication with the drive motor for manually changing the direction of rotation of the grinding wheel.

8. The bi-directional grinder as recited in claim 7, further comprising a power switch.

9. A method of locking a grinding wheel in place within the bi-directional grinder as recited in claim 8, comprising the steps of:

immobilizing the shaft;

immobilizing the grinding wheel;

placing the grinding wheel onto the shaft from the threaded bottom end;

inserting the nut onto the threaded bottom end;

tightening the nut against the grinding wheel;

inserting the bolt into the bore; and tightening the bolt against the nut.

10. The method of locking a grinding wheel in place as recited in claim 9, wherein the, step of immobilizing the grinding wheel further comprises the steps of:

rotating the circular gear until the spring-loaded pin is aligned with the off-center hole;

depressing the button head; and inserting the spring-loaded pin through the off-center hole.

* * * * *